US008217286B2

(12) United States Patent
Ross

(10) Patent No.: US 8,217,286 B2
(45) Date of Patent: Jul. 10, 2012

(54) SWITCH

(75) Inventor: James E. Ross, Akron, OH (US)

(73) Assignee: FirstEnergy Corp., Akron, OH (US)

( * ) Notice: Subject to any disclaimer, the term of this patent is extended or adjusted under 35 U.S.C. 154(b) by 650 days.

(21) Appl. No.: 12/363,107

(22) Filed: Jan. 30, 2009

(65) Prior Publication Data

US 2010/0194557 A1 Aug. 5, 2010

(51) Int. Cl.
*H01H 3/20* (2006.01)

(52) U.S. Cl. ..... 200/331

(58) Field of Classification Search ..... 200/331, 200/50.12, 50.13, 83 B, 81 R, 82 R, 83 R, 200/84 C, 1 B, 318, 334, 337, 339
See application file for complete search history.

(56) References Cited

U.S. PATENT DOCUMENTS

| | | | | |
|---|---|---|---|---|
| 2,864,071 | A * | 12/1958 | Johnson, Jr. | 439/477 |
| 5,096,438 | A * | 3/1992 | Black | 439/478 |
| 6,818,846 | B2 * | 11/2004 | Roberts | 200/331 |
| 2009/0183870 | A1 * | 7/2009 | Leitch | 166/244.1 |

* cited by examiner

*Primary Examiner* — Edwin A. Leon
(74) *Attorney, Agent, or Firm* — Brouse McDowell; Heather M. Barnes

(57) ABSTRACT

A portable switch enables an operator to open and close an electrical conductive pathway, such as a circuit, from a remote location. The tool may comprise a handle assembly selectively attached to an associated object. The handle assembly has a first member, which has a first position and a second position. A base clamping assembly is selectively attached to an associated open point, such as, but not limited to, an underground switch. A cable has a first end and a second end. The first end is operatively connected to the base clamping system. The second end is connected to an insulating portion. The insulating portion may be interposed between the base clamping assembly and the handle assembly.

22 Claims, 11 Drawing Sheets

SWITCH

BACKGROUND OF THE INVENTION

A. Field of Invention

This invention pertains to the art of methods and apparatuses for switches utilized to isolate and move voltage so that sections of circuitry may be repaired or replaced.

B. Description of the Related Art

It is known in the art for oil switches to be used in the electrical industry for energizing or de-energizing circuits. Typical oil switches enable operators to sectionalize cable so that it may be repaired, replaced, or the like. Frequently, the circuits at issue are underground and operators obtain access to them through manholes. Since the oil switches are able to move voltage from one place to another, operators are able to perform necessary work on circuits while maintaining their customers in service.

While current oil switches are suited for their intended purpose, the technology is deficient for providing remote access to open and close the oil switch. Until now, the oil switch must be opened and closed while an operator was underground. What is needed is a tool that enables the operator to energize or de-energize a circuit from a location distantly located from the underground switch. Further, it is also desirable to have a tool that is selectively attachable to an operator's vehicle or the like to easily move the tool from location to location.

The present invention provides methods and apparatuses for mobile tools that enable an operator to remotely energize and de-energize circuits.

SUMMARY OF THE INVENTION

According to one aspect of the present invention, a new and improved tool is provided which may comprise a handle assembly selectively attached to an associated object. The handle assembly has a handle member, which has a first position and a second position. The tool further comprises a base clamping assembly that selectively attaches to an associated underground switch or other open point. A cable operatively connects to the base clamping assembly. An insulation member has a first end and a second end. Further, the insulation member may be interposed between the base clamping assembly and the handle assembly.

It is an object of the present invention to provide a tool that is portable.

Another object of the present invention is to provide a tool that is able to open and close an electrically conductive pathway from an aboveground location.

Further, another object of the present invention is to provide a tool, wherein the first position of the handle assembly is a lock position and the second position of the handle assembly is an unlock position.

Still yet, another object of the present invention is to provide a tool, wherein the handle assembly may further comprise a housing having a first hole and a second hole defined therein; an attachment member connected to the housing and selectively attached to the object; wherein the handle member may have an aperture defined therein such that the handle member pivots to align the aperture with the first hole of the housing or the second hole of the housing.

Yet, another object of the present invention is to provide a tool wherein the insulation member may comprise a fiberglass rod; and a fiberglass link rod, wherein the fiberglass rod and the fiberglass link rod are operatively connected to the handle assembly.

Another object of the present invention is to provide a tool wherein the insulation member is a hot stick.

Still, another object of the present invention is to provide a tool, wherein the cable may be at least one hundred feet long.

Further, another object of the present invention is to provide a tool, wherein the base clamping assembly may further comprise a housing; a lever shift assembly operatively connected to the housing, the lever shift assembly having a switch handle; a base plate operatively connected to the housing; and a base clamping system operatively connected to the base plate.

Yet, another object of the present invention is to provide a tool, wherein the base clamping system may further comprise a strap having a first end and a second end; and a cam, wherein the strap operatively connects to the base plate at the first end and the strap operatively connects to the cam at the second end, the cam selectively attachable to the underground switch.

Another object of the present invention is to provide a tool, wherein the strap is nylon.

Further yet, another object of the present invention is to provide a remote switch assembly, comprising an object; an underground switch; and a tool interconnected between the object and the underground switch, the tool comprising a handle assembly selectively attached to the object; the handle assembly having a handle member, the handle member having a first position and a second position; a base clamping assembly, the base clamping assembly selectively attached to the underground switch; a cable operatively connected to the base clamping assembly; and an insulation member having a first end and a second end, the insulation member interposed between the base clamping assembly and the handle assembly.

Still, another object of the present invention is to provide a remote switch assembly, wherein the object is a vice.

Another object of the present invention is to provide a remote switch assembly, wherein the underground switch may be an oil switch.

Further, another object of the present invention is to provide a remote switch assembly, wherein the base clamping assembly may further comprise a base plate assembly having a first appendage, a second appendage, a coupling plate, and a securing device; and, a slide assembly operatively connected to the base plate assembly, the slide assembly having a slide base, a cable support, and a lever slide.

Further yet, another object of the present invention is to provide a remote switch assembly, wherein the slide base may be operatively coupled to the coupling plate, wherein the slide base may have a slide channel defined therein adapted to receive the lever slide.

Still yet, another object of the present invention is to provide a remote switch assembly, wherein the cable may be operatively coupled to the lever slide such that movement of the handle between a first position and the second position causes movement of the lever slide within the slide channel.

Another object of the present invention is to provide a method for opening and closing an electrically conductive pathway from a remote location, which may comprise the steps of:

providing an electrically conductive pathway having at least a first open point and a second open point;

providing a handle assembly selectively attached to an object, the object being aboveground; the handle assembly having a handle member, the handle member having a first position and a second position; a base clamping assembly, the base clamping assembly selectively attachable to one of the first open point or the second open point; a cable operatively connected to the base clamping assembly and the handle assembly; and an insulation member having a first end and a second end, the insulation member interposed between the base clamping assembly and the handle assembly;

moving the base clamping assembly underground;

selectively attaching the base clamping assembly to one of the first open point or the second open point;

selectively attaching the handle assembly to the object;

moving the first member to the first position;

opening the electrically conductive pathway.

Another object of the present invention is to provide a method for opening and closing an electrically conductive pathway from a remote location, which may further comprise the steps of:

moving the first member to the second position; and closing the electrically conductive pathway.

Yet, another object of the present invention is to provide a method for opening and closing an electrically conductive pathway from a remote location, wherein the base clamping assembly may further comprise:

a housing;

a lever shift assembly operatively connected to the housing, the lever shift assembly having a switch handle;

a base plate operatively connected to the housing;

a base clamping system operatively connected to the base plate;

a strap having a first end and a second end; and a cam, wherein the strap operatively connects to the base plate at the first end and the strap operatively connects to the cam at the second end. XXX securing device: includes cam or ratchet strap (change throughout document)

Further, another object of the present invention is to provide a method for opening and closing an electrically conductive pathway from a remote location, which may further comprise the step of selectively attaching the cam to either the first open point or the second open point.

Still, another object of the present invention is to provide a method for opening and closing an electrically conductive pathway from a remote location, which may further comprise the step of selectively moving the switch handle from a first position to a second position to either open or close the electrically conductive pathway.

Another object of the present invention is to provide a method for opening and closing an electrically conductive pathway from a remote location, which may further comprise the steps of:

disconnecting the base clamping assembly from the open point;

moving the base clamping assembly and the cable above ground;

removing the handle assembly from the object; and moving the tool to a second location.

Another object of the present invention is to provide a tool that is cost effective to manufacture.

Further, another object of the present invention is to provide a tool that is easy to use.

Still other benefits and advantages of the invention will become apparent to those skilled in the art to which it pertains upon a reading and understanding of the following detailed specification.

BRIEF DESCRIPTION OF THE DRAWINGS

The invention may take physical form in certain parts and arrangement of parts, a preferred embodiment of which will be described in detail in this specification and illustrated in the accompanying drawings which form a part hereof and wherein.

DETAILED DESCRIPTION OF THE INVENTION

Figure 1:
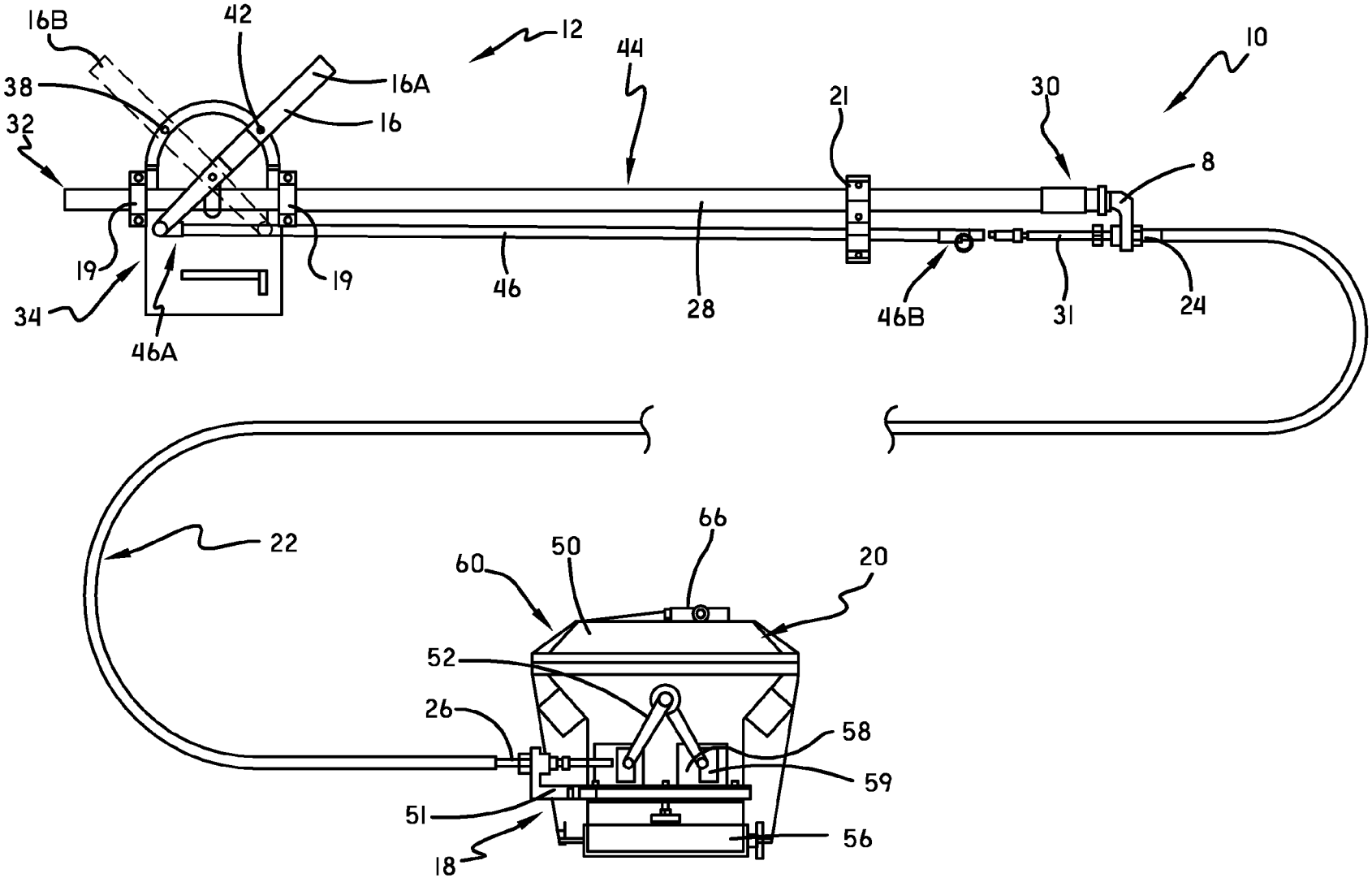
FIG. 1 is a front elevational view of the present invention.

Referring now to the drawings wherein the showings are for purposes of illustrating embodiments of the invention only and not for purposes of limiting the same, FIGS. 1-6 illustrate the present invention.

The present invention may be described as a switch taking the form of an underground switching tool 10 that enables an operator to open and close an electrical conductive pathway, such as a circuit, from a remote location. Generally, electrical conductive pathways, such as circuits, network circuits and underground circuits, are found underground in municipalities and other urban areas. In order to gain access to these circuits, operators must go underground, usually through manholes. Once the circuit has been identified, operators go underground and try to isolate portions of the circuit so that repairs, modifications, and upgrades may be performed.

Figure 2A:
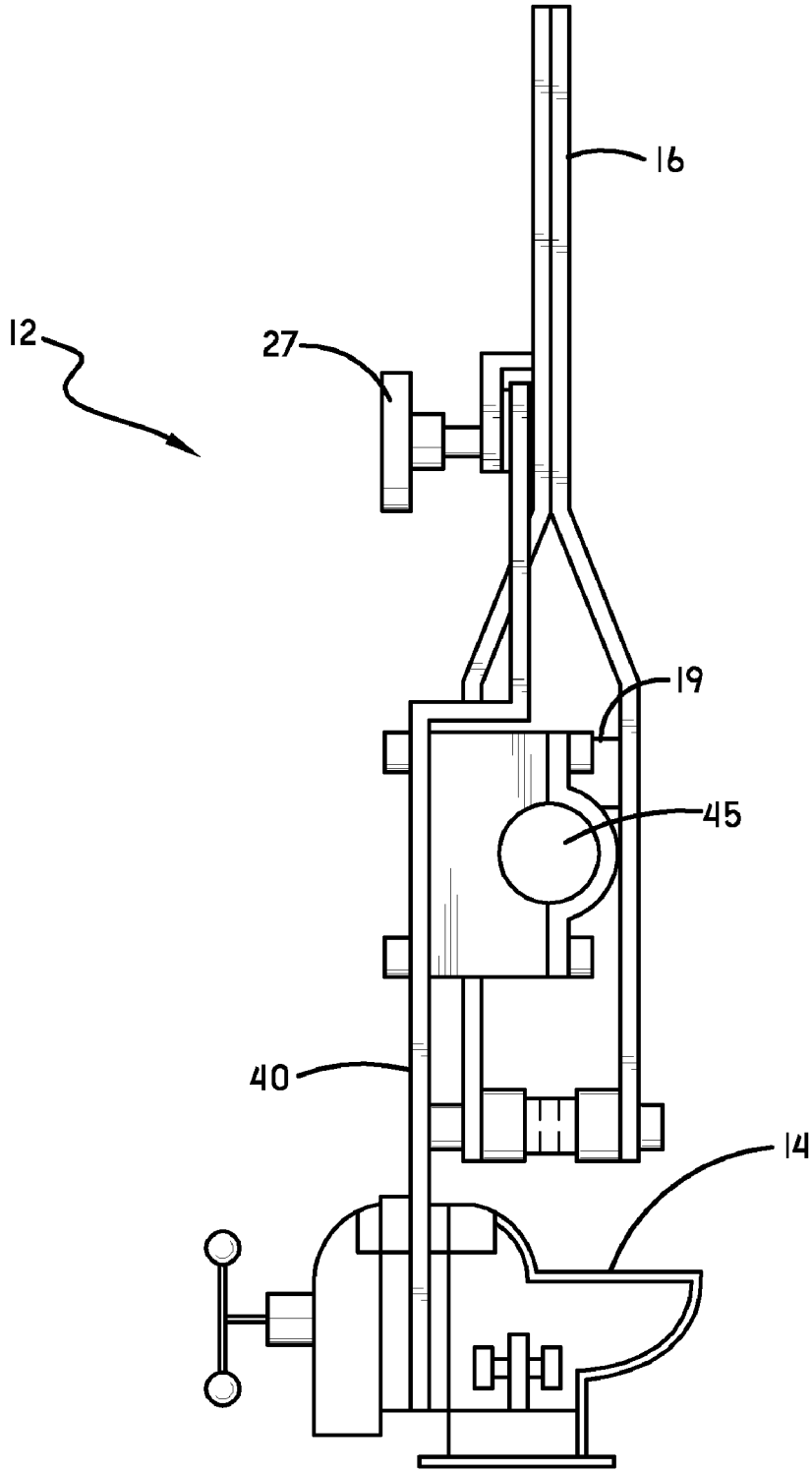
FIG. 2A is an end view of the handle assembly of the present invention.
Figure 2B:
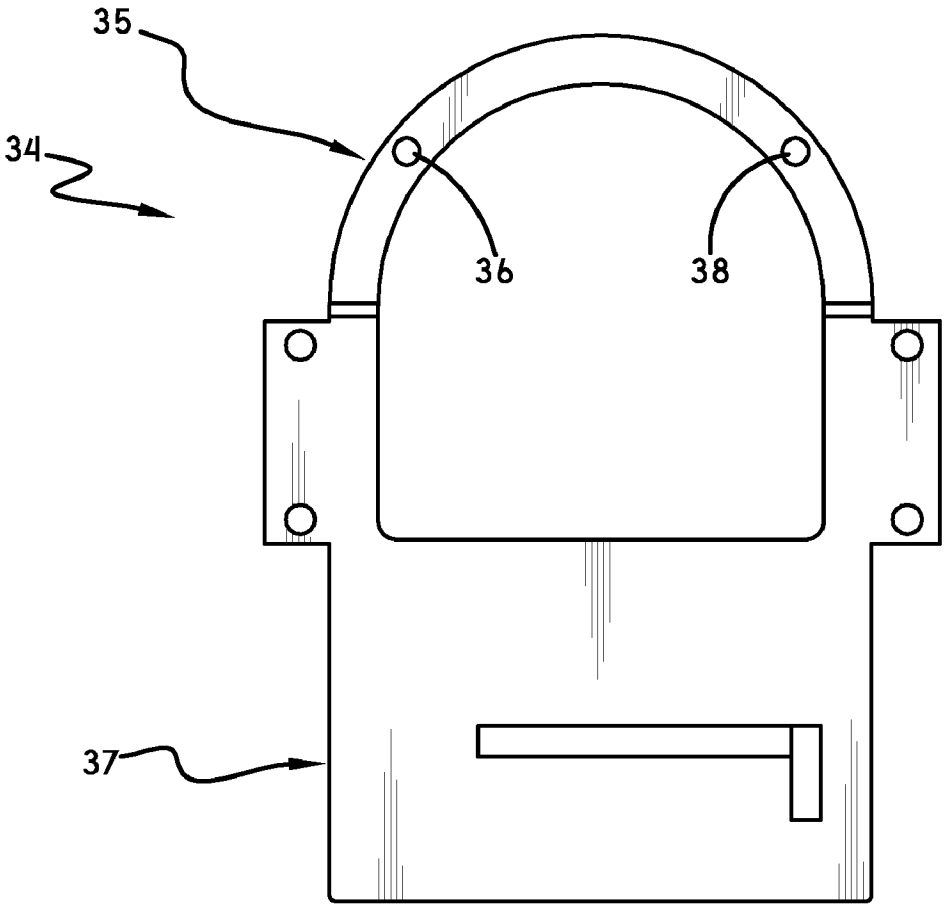
FIG. 2B is a partial perspective view of an underground switching tool showing a housing according to one embodiment of the invention.
Figure 3A:
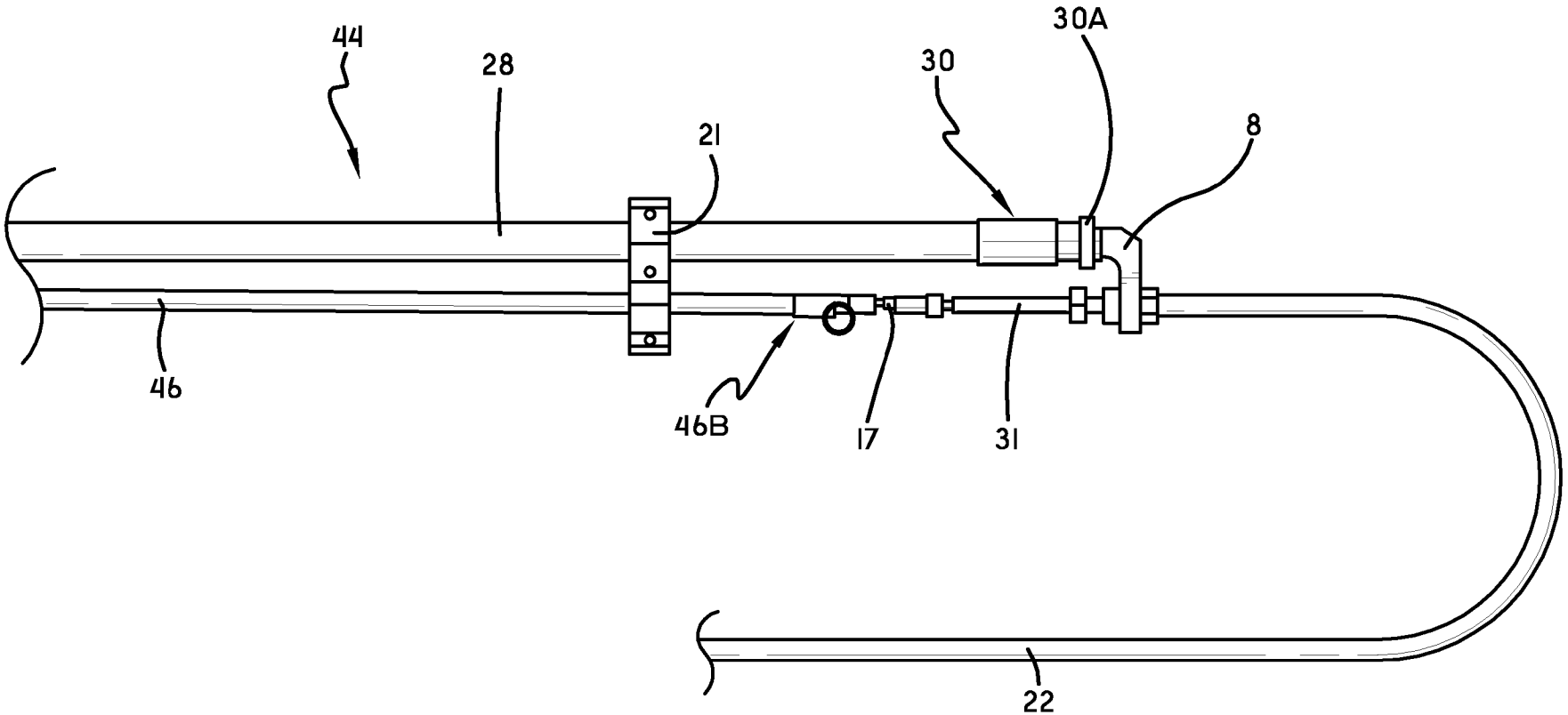
FIG. 3A is a partial perspective view of an underground switching tool showing an insulating portion according to one embodiment of the invention.
Figure 3B:
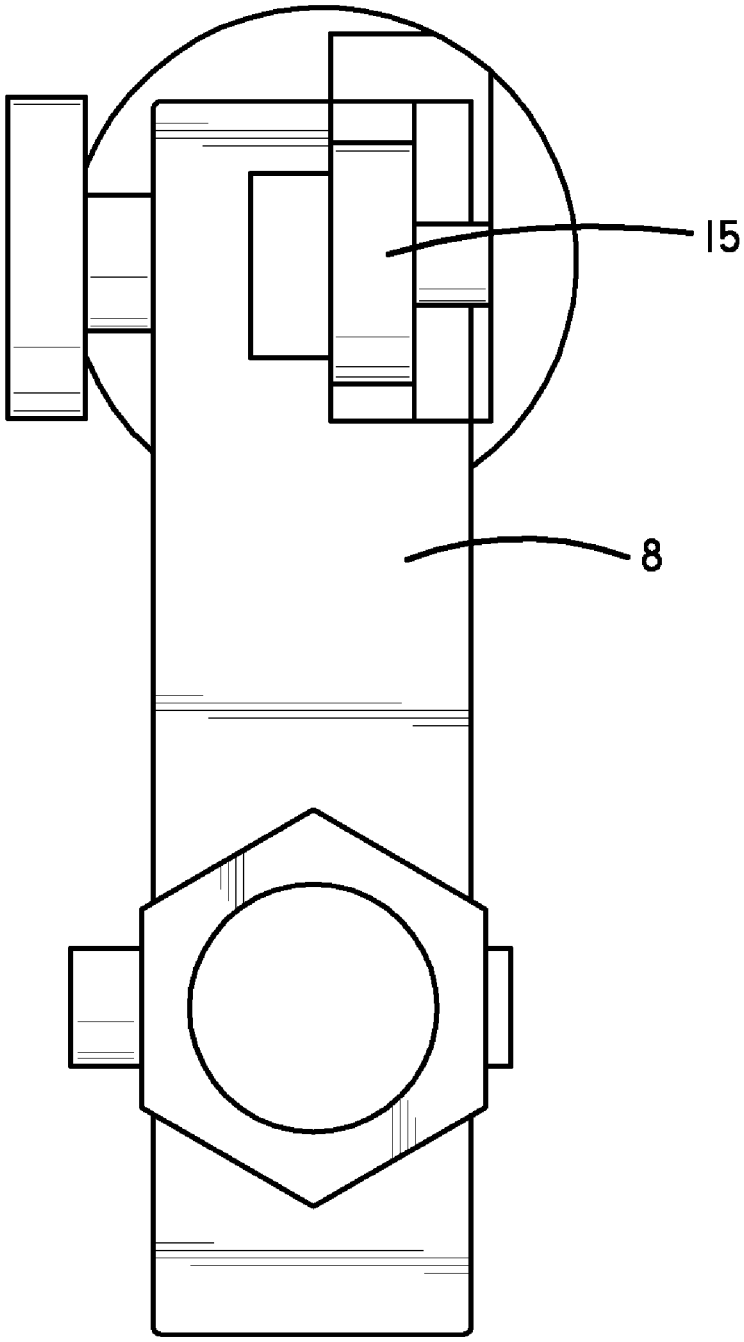
FIG. 3B is a end view of the insulating portion shown in FIG. 3A.
Figure 4A:
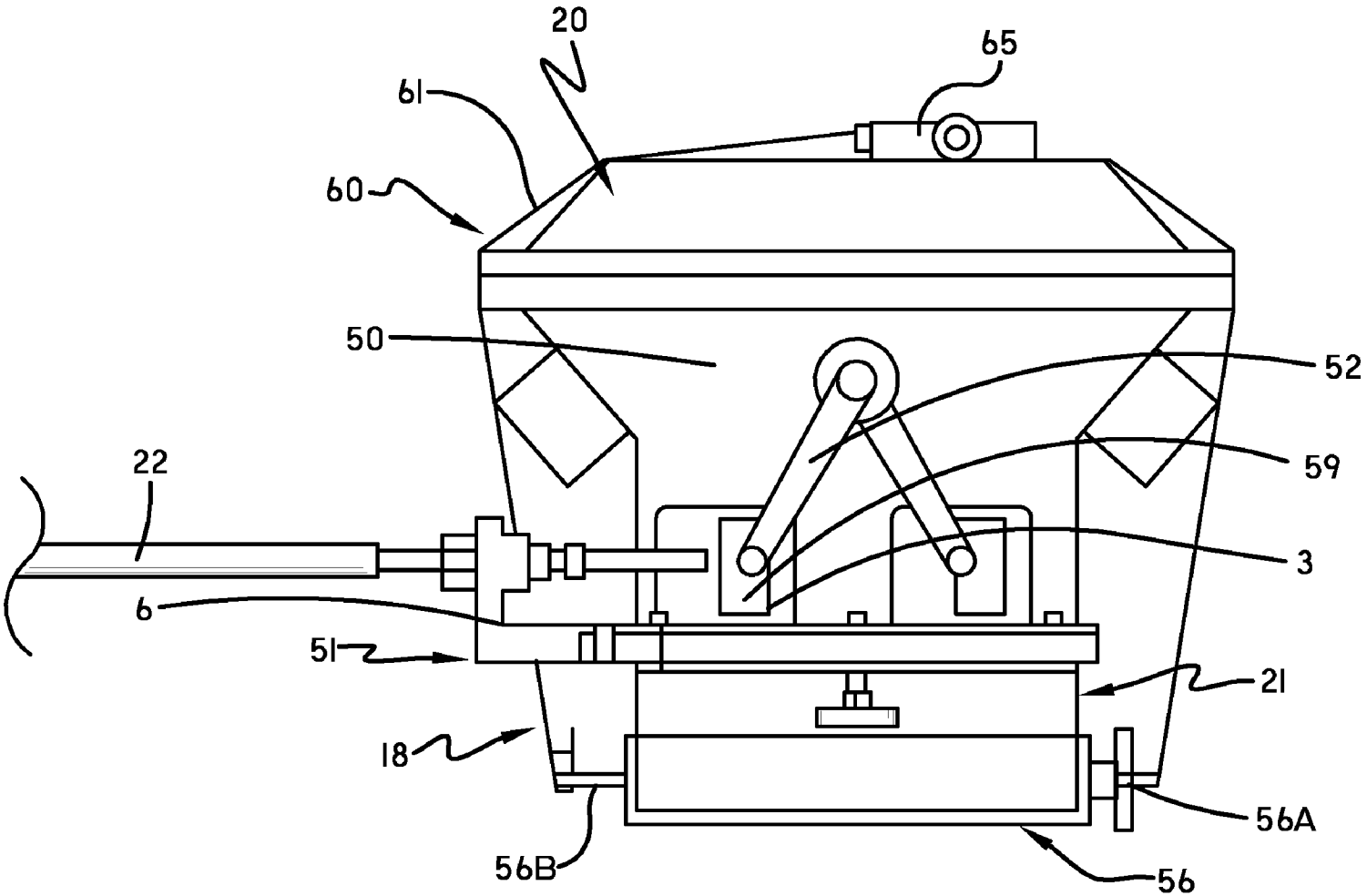
FIG. 4A is a partial perspective view of an underground switching tool showing a base clamping assembly according to one embodiment of the invention.
Figure 4B:
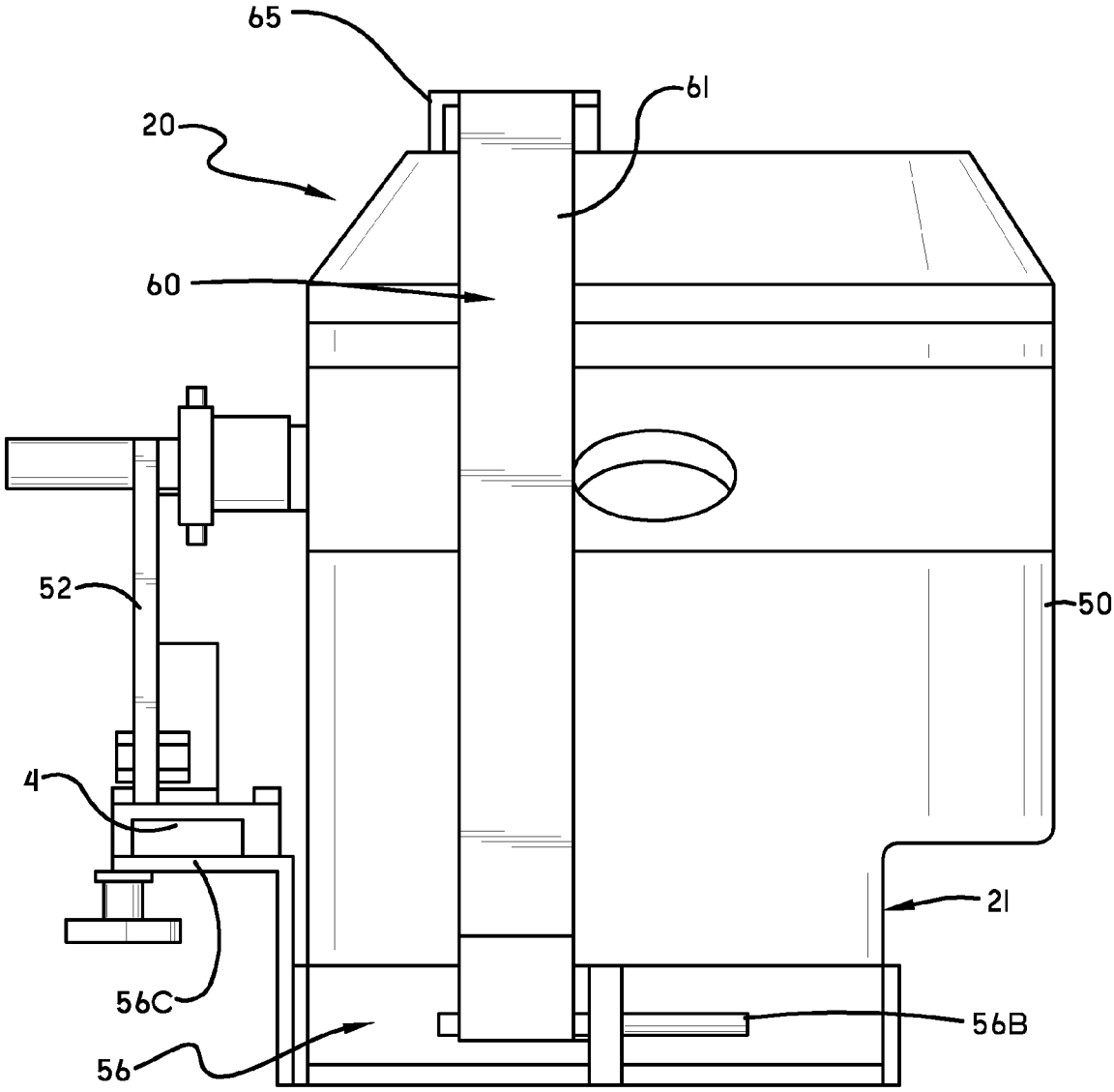
FIG. 4B is a end view of the base clamping system shown in FIG. 4A.
Figure 4C:
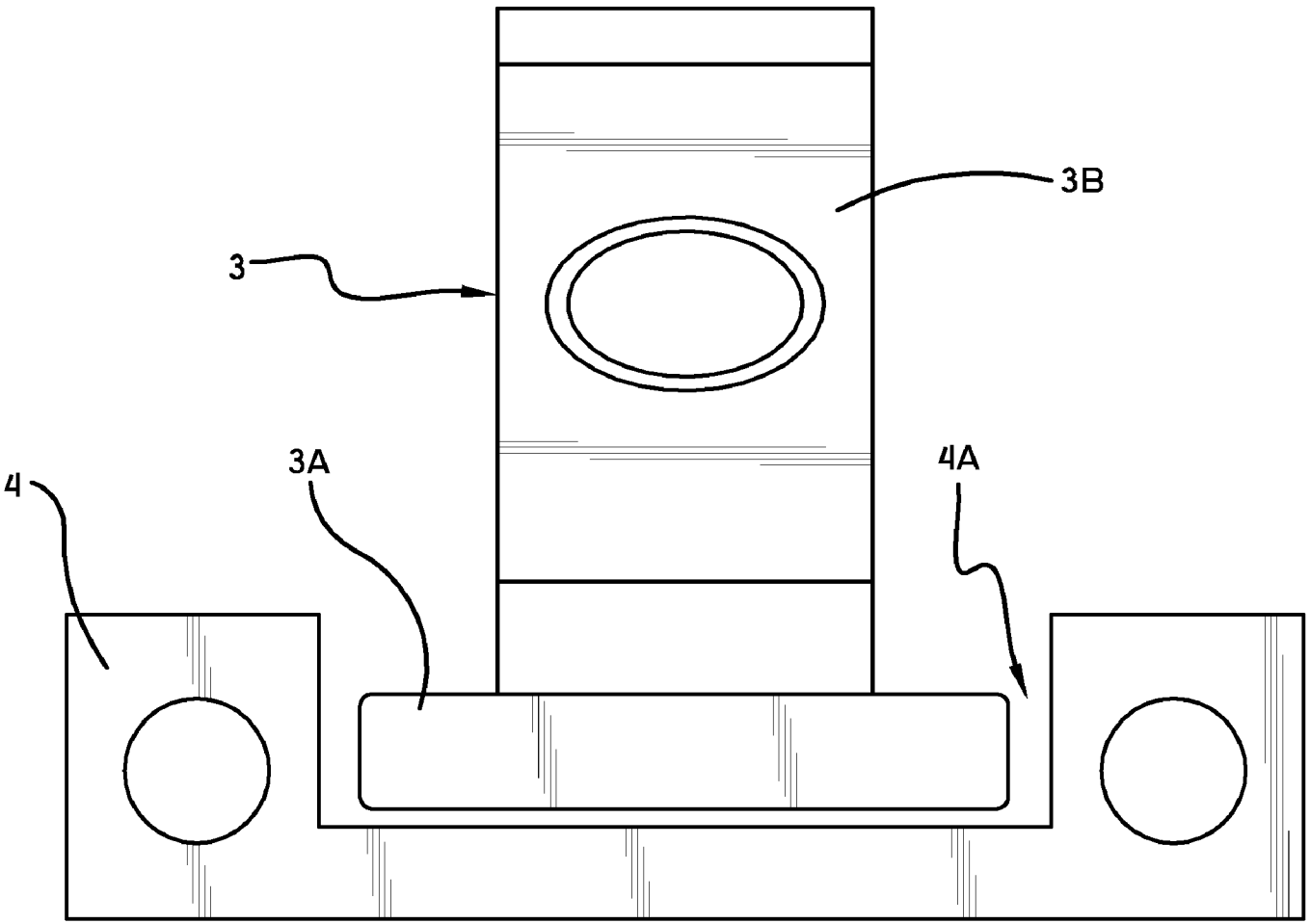
FIG. 4C is a partial perspective end view of an underground switching tool showing a slide base and a lever slide according to one embodiment of the invention.

With reference now to FIGS. 1, 2A, and 2B, the underground switching tool 10 may comprise a handle assembly 12, an insulating portion 44, and a base clamping assembly 18. The handle assembly 12 may comprise a handle member 16, a housing 34, and an attachment member 40. In one embodiment, the handle member 16 may be a generally elongated member that is operatively coupled to both the housing 34 and the insulating portion 44. The handle member 16 may comprise an aperture 42 defined therein, and it may be selectively positioned between a first position 16A and a second position 16B. The first position 16A of the handle assembly may comprise a lock position. The second position 16B of the handle assembly 12 may comprise an unlock position.

With continued reference to FIGS. 1, 2A, and 2B, the housing 34 may comprise an upper portion 35 and a lower portion 37. In one embodiment, the housing 34 may comprise a single integral piece. However, it is contemplated to be within the scope of the invention to have the housing 34 composed of multiple pieces and joined together. The upper portion 35 may comprise a unshaped portion and may provide for an ergonomic carrying means for the operator so that the handle assembly 12 may be easily moved from location to location. The upper portion 35 may comprise a first hole 36 and a second hole 38 defined therein. The placement of the handle member 16 in the first position 16A may cause the aperture 42 of the handle member 16 to be substantially aligned with the first hole 36. The placement of the handle member 16 in the second position 16B may cause the aperture 42 to be substantially aligned with the second hole 38. The alignment of the aperture 42 with the first hole 36 or the second hole 38 may allow for the insertion of a hand knob 27 (as shown in FIG. 2A) thereby preventing the movement of the handle member 16 from the first position 16A or the second position 16B respectively.

Figure 5:
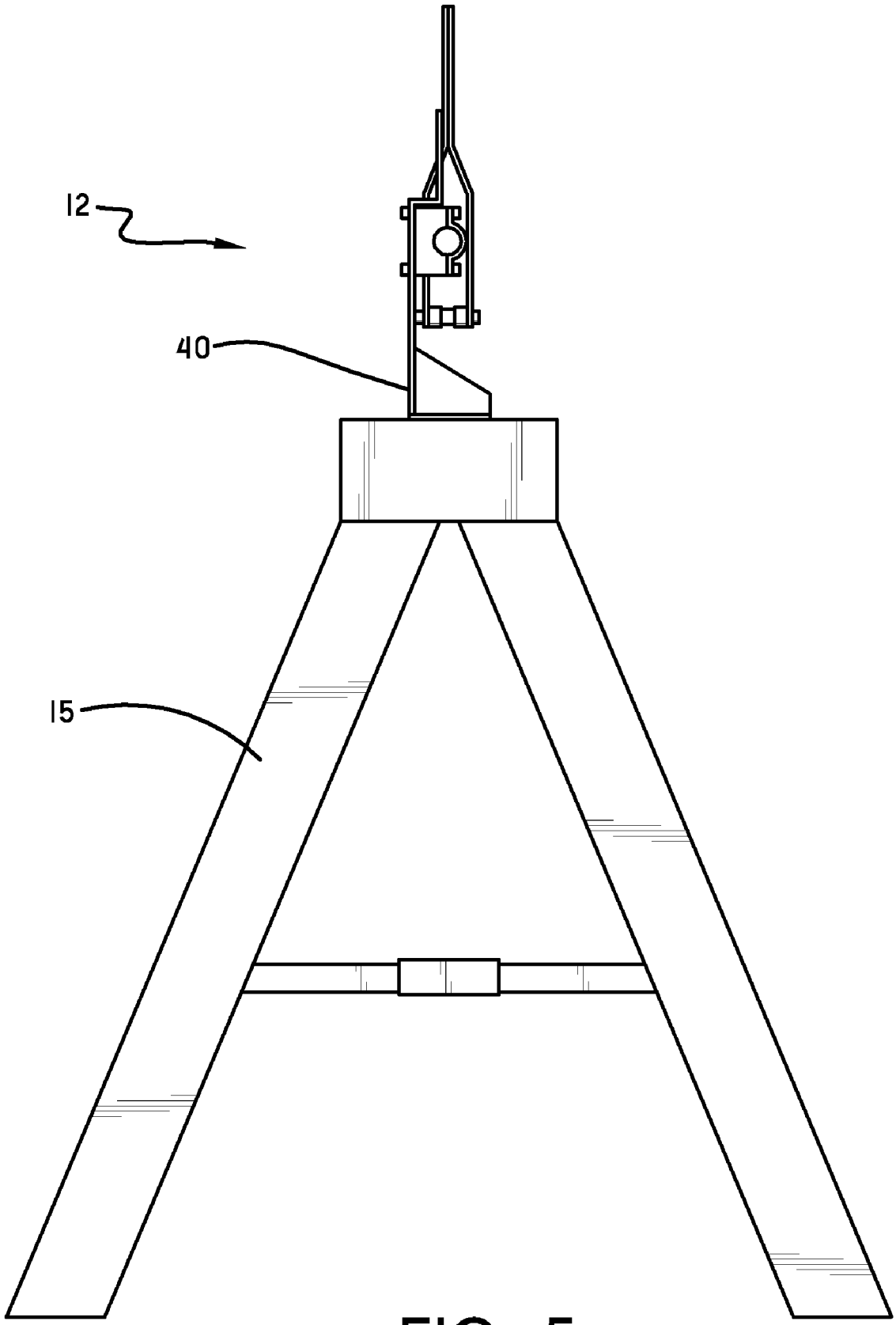
FIG. 5 is a front elevational view of a second embodiment of the present invention; and, FIG. 6 is a end view of FIG. 5.
Figure 6:
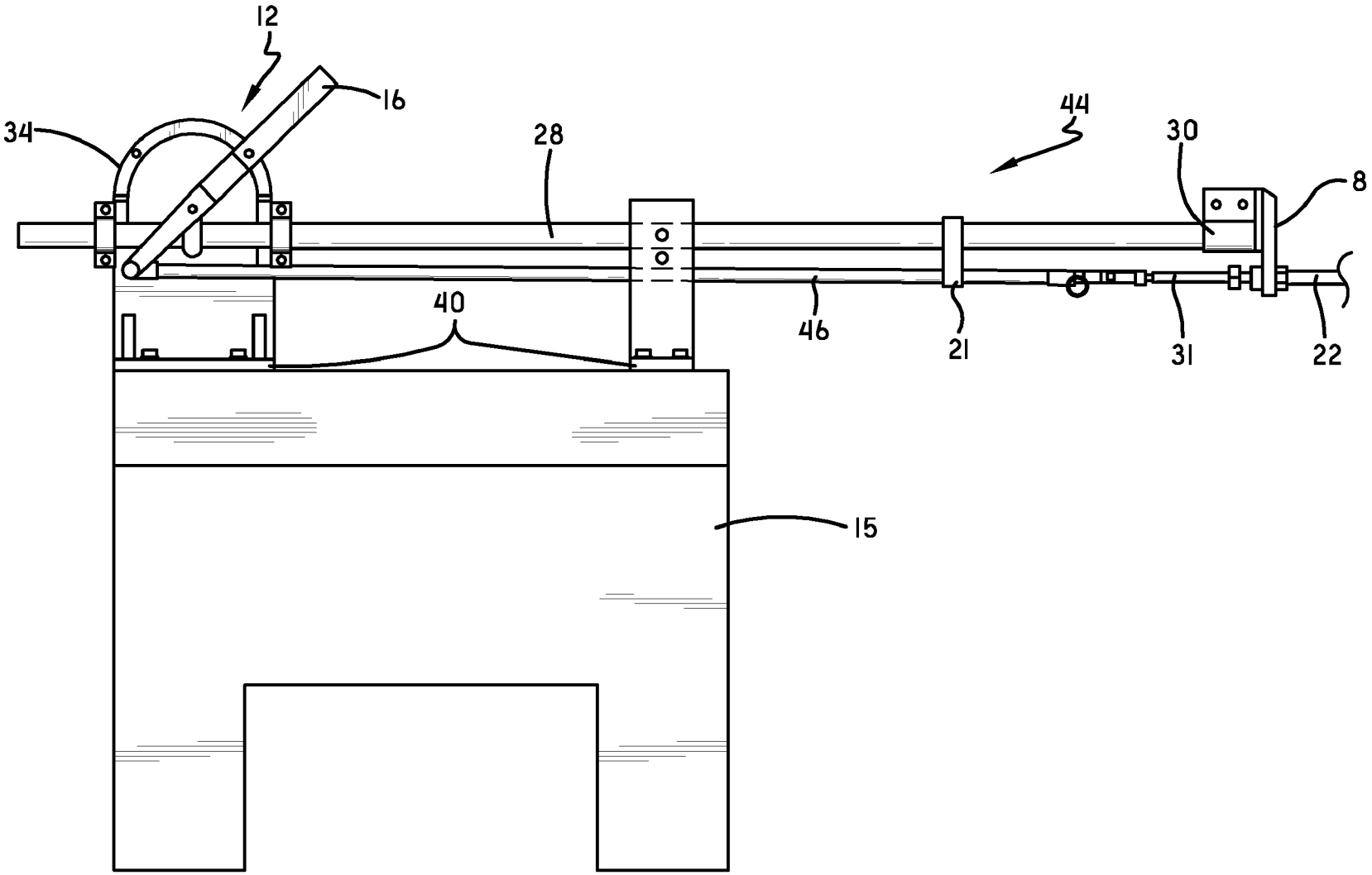

With reference now to FIGS. 1 and 2B, an attachment member 40 has an upper portion 35 and a lower portion 37. Alternatively, the attachment member 40 may be several pieces attached together utilizing conventional fasteners such as screws. In another embodiment, the attachment member 40 may be an integral member of the housing 34. The attachment member 40 may comprise a member that is capable of securing the handle assembly 12 of the underground switching tool 10 such that the operator can easily move the handle member 16 from the first position 16A to the second position 16B as well as from the second position 16B to the first position 16A. The attachment member 40 may comprise a member that is selectively attachable to an object 14. The object 14 may be a stationary member such as a vice, as shown in FIG. 2A, that may be attached to the operator's truck (not shown) or a storage horse 15, as shown in FIGS. 5 and 6.

With reference now to FIGS. 1, 2A, 3A, and 3B, the insulating portion 44 may comprise an insulating member 28, a fiberglass link rod 46, a guide assembly 21, and a secondary portion 31 of the cable 22. The insulating portion 44 may be interposed between the base clamping assembly 18 and the handle assembly 12. In one embodiment, the insulation portion 44 may take the form of a hot stick that is commercially available from A B Chance of Centralia, Mo., operatively coupled with the cable 22 and the secondary portion 31 of the cable 22. The insulation member 28 and the fiberglass link rod 46 may each comprise an elongated member formed of a fiberglass composition. The insulation member 28 may comprise a first end 30 and a second end 32. The first end 30 may comprise a coupling member 30A and may be operatively coupled to a coupling plate 8. The second end 32 of the insulation member 28 may extend through a first channel 45 of a stick clamp 19 that attaches the insulation member 28 to the lower portion 37 of the housing 34. The fiberglass link rod 46 may be operatively coupled to and extend between the handle member 16 and the secondary cable 31. The fiberglass link rod 46 and the insulating member 28 may extend through the guide assembly 21 such that the fiberglass link rod 46 is positioned substantially parallel to and below the insulation member 28. In one embodiment, the fiberglass link rod 46 may comprise a first end 46A and a second end 46B. The first end 46A may be operatively coupled to the handle member 16. The second end 46B may be operatively coupled to the secondary cable 31 via a coupling joint 17. The secondary cable 31 may extend between the fiberglass link rod 46 and the coupling plate 8. In one embodiment, the coupling joint 17 may comprise a ball joint. In another embodiment, the coupling joint 17 may comprise a swivel adapter. The fiberglass link rod 46 may be operatively coupled to the secondary cable 31 utilizing any method chosen with sound judgment by a person of ordinary skill in the art.

With reference now to FIG. 1, a cable 22 may extend between the coupling plate 8 and the base clamping assembly 18. The cable 22 and the secondary cable 31 may both allow for the transfer of push-pull motions from one point to another. In one embodiment, the cable 22 and the secondary cable 31 may comprise a single, multi-stranded wire that is slidable within a housing. In another embodiment, the cable 22 may take the form of a Flexball Push Pull Control Cable that is commercially available from VPS Control Systems, Inc., of Troy, N.Y. The cable 22 may be thirty feet long, and in a second embodiment it may be sixty feet long or as in another embodiment one hundred feet long. The length of the cable 22 should be sufficient between the handle assembly 12 and the base clamping assembly 18 such that there is sufficient length for an operator to connect the base clamping assembly 18 to an open point 20 and take the handle assembly 12 up through the manhole to the operator's vehicle, the object 14, or the storage horse 15. As used herein, the term "open point" or "electrical connection" may mean a switch, an above ground disconnect, a substation breaker, or an underground breaker; however, connection between the base clamping assembly 18 and the open point will be underground.

With reference to FIGS. 1, 4A, 4B, and 4C, the base clamping assembly 18 may comprise a cable slide assembly 51 and a base plate assembly 56. The base clamping assembly 18 may be selectively attached to an associated open point 20. The open point 20, may comprise an underground switch, an underground breaker or other electrical connection. In one embodiment, the open point 20 may comprise a switch such as an oil switch, or other switch, commonly found underground in an electric circuit, which includes an electrical conductive pathway. The open point 20 may comprise a switch tank 50 and a lever 52 operatively connected to the switch tank 50. The movement of the lever 52 between a first and a second position may cause the opening and closing of the open point 20. The lever 52 may be part of the switch tank 50 or it may be removable so that it can be selectively removed and replaced. Open points disclosed herein are well known in the art and, therefore, will not be further discussed.

Figure 1A:
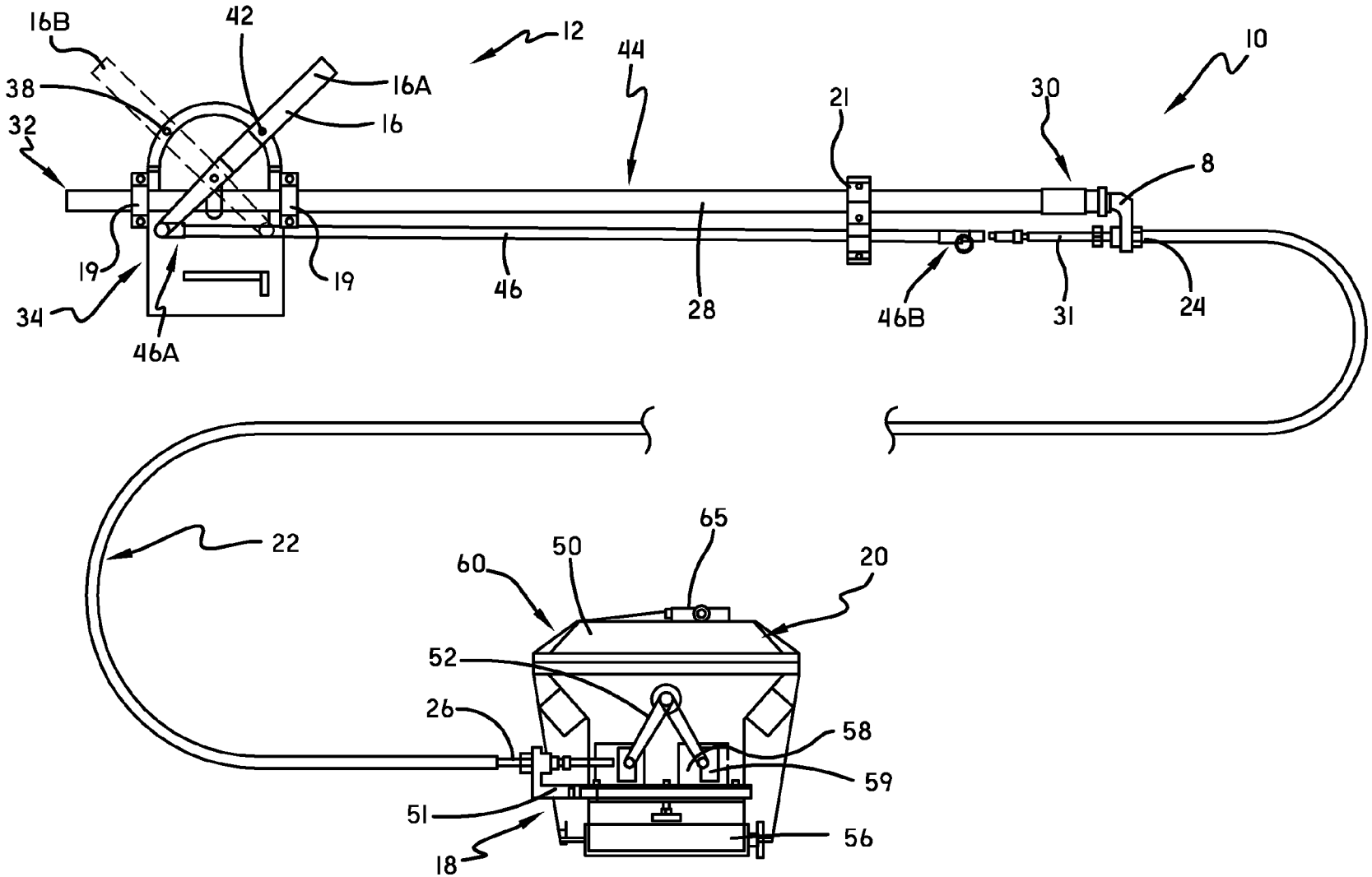
FIG. 1A is a front elevational view of another embodiment of the present invention.

With continued reference now to FIGS. 1, 4A, 4B and 4C, the base plate 56 may comprise a first appendage 56A, a second appendage 56B, a slide assembly coupling plate 56C, and a securing device 60. In one embodiment the base plate assembly 56 may substantially encircle a base portion 21 of the open point 20. The securing device 60 may extend from the first appendage 56A to the second appendage 56B thereby coupling the base clamping assembly to the open point 20. In one embodiment, the securing device may comprise a strap 61 and a cam 66. The strap 61 may be interwoven with the cam 66 such that the cam 66 can be operated to loosen and tighten the strap 61 around the open point 20. In one embodiment, the strap 61 may comprise a nylon. In another embodiment, as shown in FIG. 1A, the securing device 60 may be a ratchet strap 65 which is utilized in a manner known to one of ordinary skill in the art).

With continued reference to FIGS. 1, 4A, 4B, and 4C, the cable slide assembly 51 may comprise a slide base 4, a cable support 6, and a lever slide 3. The slide base 4 may be coupled to the slide assembly coupling plate 56C and may comprise a slide channel 4A. The cable support 6 may be coupled to the slide base 4. The lever slide 3 may comprise a lever slide base 3A and a cavity 59 formed within a lever slide upper portion 3B. The cavity 59 may be adapted to receive the lever 52 of the open point 20. The lever 52 comprises an open position and a closed position. The lever 52 may comprise a roller bearing or similar device to enable it to freely move from the open and closed positions. The space of the cavity 59 may provide relief for the lever 52 as the lever slide 3 travels within the slide channel 4A of the cable support slide 4. The cable 22 may extend through the slide channel 4A and may be coupled to the lever slide upper portion 3B such that the movement of the handle assembly 16 between the first position 16A and the second position 16B at least partially causes the linear movement of the lever slide 3 along the slide channel 4A relative to the base plate assembly 56. The lever slide 3 may be adapted to move in a horizontal direction within the slide channel 4A of the cable support slide 4. It should be noted that the movement of the lever slide 3 within the slide channel 4A of the cable support slide 4 need not necessarily be in a horizontal direction. The direction of motion of the lever slide 3 within the slide channel 4A of the cable support slide 4 will be dependent upon the direction of motion required to operate the lever 52 of the open point 20.

As described in the foregoing description, it is evident that one of the advantages of the present invention is that the underground switching tool 10 is portable. As such, an operator may take the underground switching tool 10 and store it on his or her vehicle. The underground switching tool 10 may be taken from location to location in order to service, repair or modify certain parts of the circuit through underground manholes.

In order to utilize the present invention, namely, in order to open and close an electrically conductive pathway from a remote location, the following steps are taken. An electrically conductive pathway is provided having at least a first open point 20. The underground switching tool 10 previously described is provided. The base clamping assembly 18 is mobilized underground. The base clamping assembly 18 is selectively attached to the open point 20. The securing device 60 may be utilized to selectively attach the base plate assembly 56 to the first open point 20 thereby coupling the base clamping assembly 18 thereto. The lever 52 of the open point 20 can be moved between a first position and a second position to either open or close the electrically conductive pathway associated with the open point 20. The base clamping assembly 18 is coupled to the open point 20 such that the cavity 59 receives the lever 52. Next, the handle assembly 12 may be selectively attached to the object 14 wherein the object 14 is located at an above ground location. The handle assembly 12 may be selectively attached to the object 14 such that the cable 22 extends from the base clamping assembly 18 to the handle assembly 12. The handle member 16 of the handle assembly may initially be positioned in the first position 16A, which may comprise a closed position. As such, the electrically conductive pathway associated with the open point 20 is closed or energized. The method may further comprise the steps of moving the handle member 16 to the second position 16B. The second position 16B may comprise an open position. The movement of the handle member 16 between the first position 16A and the second position 16B may cause the linear movement of the lever slide 3 within the slide channel 4A. The lever 52 of the open point 20 may be received by the cavity 59 such that the linear movement of the lever slide 3 within the slide channel 4A causes the lever 52 to move between the first and second positions thereby opening and closing the associated electrically conductive pathway. Therefore, the movement of the handle member 16 to the second position 16B may cause the movement of the lever 52 to the second position thereby opening the open point 20. The opening of the open point 20 causes the electrically conductive pathway associated with the open point 20 to be de-energized. Subsequently, the handle member 16 may be moved back to the first position 16A. The movement of the handle member 16 may cause the lever 52 to move to the first position thereby closing the open point 20. The underground switching tool 10 can then be uncoupled and moved to a second location.

Based upon the foregoing, it is evident that the present invention provides both portability and remote access to opening and closing circuits. As such, circuits may be energized and de-energized by operators located above ground rather than underground.

The embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

Having thus described the invention, it is now claimed:

What is claimed is:

1. An apparatus, comprising:

a handle assembly selectively attached to an associated object, said handle assembly having a handle member, said handle member having a first position and a second position;

a base clamping assembly, said base clamping assembly selectively attached to an associated open point, said base clamping assembly further comprising a base plate operatively connected to said open point; and a securing device, wherein the securing device operatively connects said base plate to said open point;

a cable operatively connected to said base clamping assembly and an insulating portion; and said insulating portion, said insulating portion interposed between said base clamping assembly and said handle assembly.

2. The apparatus of claim 1, wherein said first position of said handle assembly is an open position and said second position of said handle assembly is a closed position.

3. The apparatus of claim 1, wherein said handle assembly further comprises:

a housing having a first hole and a second hole defined therein;

an attachment member connected to the housing and selectively attached to an object;

wherein said handle member has an aperture defined therein such that said handle pivots to align said aperture with said first hole of said housing or said second hole of said housing.

4. The apparatus of claim 1, wherein said insulating portion comprises:

an insulation member; and a fiberglass link rod, wherein said insulation member and said fiberglass link rod are operatively connected to said handle assembly.

5. The apparatus of claim 1, wherein said insulating portion comprises a hot stick.

6. The apparatus of claim 1, wherein said cable is at least one hundred feet long.

7. The apparatus of claim 1, wherein said securing device further comprises:

a strap having a first end and a second end, wherein said strap operatively connects to said base plate at said first end of said strap and said strap operatively connects to a cam at said second end of said strap, said cam can be operated to loosen or tighten said strap around said open point.

8. The apparatus of claim 7, wherein said strap is nylon.

9. A remote switch assembly, comprising:

an object; and a tool interconnected between said object and an open point, wherein said open point is an underground switch, said tool comprising:

a handle assembly selectively attached to said object; said handle assembly having a handle member, said handle member having a first position and a second position;

a base clamping assembly, said base clamping assembly selectively attached to said open point;

a cable operatively connected to said base clamping assembly; and an insulating portion, said insulating portion interposed between said base clamping assembly and said handle assembly.

10. The remote switch assembly of claim 9, wherein said object is a vice.

11. The remote switch assembly of claim 9, wherein said handle assembly further comprises:

a housing having a first hole and a second hole defined therein;

an attachment member connected to the housing and selectively attached to the object, said handle member being pivotable and having an aperture defined therein such that said handle member pivots to align said aperture with said first hole of said housing or said second hole of said housing.

12. The remote switch assembly of claim 11, wherein said insulating portion comprises:

an insulation member; and a fiberglass link rod, wherein said insulation member and said fiberglass link rod are operatively connected to said housing.

13. The remote switch assembly of claim 9, wherein said base clamping assembly further comprises:

a base plate assembly having a first appendage, a second appendage, a coupling plate, and a securing device; and, a slide assembly operatively connected to said base plate assembly, said slide assembly having a slide base, a cable support, and a lever slide.

14. The remote switch assembly of claim 13, wherein said slide base is operatively coupled to said coupling plate, wherein said slide base has a slide channel defined therein adapted to receive said lever slide.

15. The remote switch assembly of claim 14, wherein said cable is operatively coupled to said lever slide such that movement of said handle between a first position and said second position causes movement of said lever slide within said slide channel.

16. The apparatus of claim 13, wherein said securing device comprises:

a ratchet strap.

17. The apparatus of claim 9, wherein said tool is portable.

18. A method for opening and closing an electrically conductive pathway from a remote location, comprising the steps of:

providing an electrically conductive pathway having at least a first open point, said first open point comprising a lever;

providing a handle assembly selectively attached to an object, said object being aboveground; said handle assembly having a handle member, said handle member having a first position and a second position; a base clamping assembly, said base clamping assembly selectively attachable to said open point; a cable operatively connected to said base clamping assembly and to said handle assembly; and, an insulating portion, said insulating portion interposed between said base clamping assembly and said handle assembly;

moving said base clamping assembly underground;

selectively attaching said base clamping assembly to said first open point;

selectively attaching said handle assembly to said object;

moving said first member to said first position;

opening said electrically conductive pathway; and, selectively moving said lever from a first position to a second position to either open or close said electrically conductive pathway.

19. The method of claim 18, further comprising the steps of:

moving said first member to said second position;

closing said electrically conductive pathway.

20. The method of claim 18, wherein said base clamping assembly further comprises:

a base plate operatively connected to said open point; and, a securing device, wherein said securing device operatively couples said base plate to said open point.

21. The method of claim 18, wherein said securing device comprises a ratchet strap.

22. The method of claim 18, further comprising the steps of:

disconnecting said base clamping assembly from said open point;

moving said base clamping assembly and said cable above ground;

removing said handle assembly from said object; and, moving said tool to a second location.

* * * * *